US007813514B2

(12) United States Patent
Asada

(10) Patent No.: US 7,813,514 B2
(45) Date of Patent: Oct. 12, 2010

(54) APPARATUS AND METHOD FOR CHECKING LOUDSPEAKER

(75) Inventor: Kohei Asada, Kanagawa (JP)

(73) Assignee: Sony Corporation (JP)

( * ) Notice: Subject to any disclaimer, the term of this patent is extended or adjusted under 35 U.S.C. 154(b) by 1198 days.

(21) Appl. No.: 11/414,835

(22) Filed: May 1, 2006

(65) Prior Publication Data

US 2006/0251265 A1 Nov. 9, 2006

(30) Foreign Application Priority Data

May 9, 2005 (JP) ..... 2005-135645

(51) Int. Cl.
*H04R 29/00* (2006.01)

(52) U.S. Cl. ..... 381/58; 700/94

(58) Field of Classification Search ..... 381/56, 381/58, 59, 300, 304, 303, 307, 17, 18; 700/94
See application file for complete search history.

(56) References Cited

U.S. PATENT DOCUMENTS 6,766,025 B1 * 7/2004 Levy et al. ..... 381/96
7,043,027 B2 * 5/2006 Wood ..... 381/58

FOREIGN PATENT DOCUMENTS

| | | | |
|---|---|---|---|
| JP | 63-024800 | A | 2/1988 |
| JP | 63-048099 | A | 2/1988 |
| JP | 62-36188 | A | 8/1994 |
| JP | 09-233591 | A | 9/1997 |
| JP | 2004-172661 | A | 6/2004 |
| JP | 2004-297368 | * | 10/2004 |
| JP | 2004-297368 | A | 10/2004 |

* cited by examiner

*Primary Examiner*—Vivian Chin
*Assistant Examiner*—Lun-See Lao
(74) *Attorney, Agent, or Firm*—Lerner, David, Littenberg, Krumholz & Mentlik, LLP

(57) ABSTRACT

A loudspeaker checking apparatus includes a signal generating unit configured to generate a test tone signal by adding first and second sinusoidal signals of different frequencies; a control circuit configured to allow the signal generating unit to generate a plurality of test tone signals by varying the frequencies; an output circuit configured to simultaneously supply the plurality of test tone signals to a plurality of loudspeakers, respectively; an analyzing unit configured to perform frequency analysis on an output signal from a microphone that picks up test tones output from the plurality of loudspeakers; and a determining unit configured to determine whether the respective loudspeakers are normal or abnormal on the basis of an analysis result made by the analyzing unit.

4 Claims, 15 Drawing Sheets

FIG. 2

| PATTERN NUMBER PN | a | b |
|---|---|---|
| 1 | 100 | 740 |
| 2 | 105 | 745 |
| 3 | 110 | 750 |
| 4 | 115 | 755 |
| 5 | 120 | 760 |
| ⋮ | ⋮ | ⋮ |
| 127 | 730 | 1370 |
| 128 | 735 | 1375 |

FIG. 3

| LOUDSPEAKER NUMBER SN | PATTERN NUMBER PN | | |
|---|---|---|---|
| | FIRST (SEQ = 1) | SECOND (SEQ = 2) | THIRD (SEQ = 3) |
| 1 | 1 | 33 | 65 |
| 2 | 2 | 34 | 66 |
| 3 | 3 | 35 | 67 |
| 4 | 4 | 36 | 68 |
| ⋮ | ⋮ | ⋮ | ⋮ |
| 64 | 64 | 96 | 128 |
| 65 | 65 | 97 | 1 |
| 66 | 66 | 98 | 2 |
| 67 | 67 | 99 | 3 |
| ⋮ | ⋮ | ⋮ | ⋮ |
| 96 | 96 | 128 | 32 |
| 97 | 97 | 1 | 33 |
| 98 | 98 | 2 | 34 |
| 99 | 99 | 3 | 35 |
| ⋮ | ⋮ | ⋮ | ⋮ |
| 128 | 128 | 32 | 64 |

FIG. 11

| PATTERN NUMBER PN | a | b |
|---|---|---|
| 1 | 100 | 868 |
| 2 | 106 | 874 |
| 3 | 112 | 880 |
| 4 | 118 | 886 |
| ---------- | ---------- | ---------- |
| 128 | 862 | 1630 |

| PATTERN NUMBER PN | a | b |
|---|---|---|
| 129 | 102 | 870 |
| 130 | 108 | 876 |
| 131 | 114 | 882 |
| 132 | 120 | 888 |
| ---------- | ---------- | ---------- |
| 256 | 864 | 1632 |

| PATTERN NUMBER PN | a | b |
|---|---|---|
| 257 | 104 | 872 |
| 258 | 110 | 878 |
| 259 | 116 | 884 |
| 260 | 122 | 890 |
| ---------- | ---------- | ---------- |
| 384 | 866 | 1634 |

FIG. 12

| LOUDSPEAKER NUMBER SN | PATTERN NUMBER PN | | |
|---|---|---|---|
| | FIRST (SEQ = 1) | SECOND (SEQ = 2) | THIRD (SEQ = 3) |
| 1 | 1 | 161 | 321 |
| 2 | 2 | 162 | 322 |
| 3 | 3 | 163 | 323 |
| ⋮ | ⋮ | ⋮ | ⋮ |
| 64 | 64 | 224 | 384 |
| 65 | 65 | 225 | 257 |
| 66 | 66 | 226 | 258 |
| ⋮ | ⋮ | ⋮ | ⋮ |
| 96 | 96 | 256 | 288 |
| 97 | 97 | 129 | 289 |
| 98 | 98 | 130 | 290 |
| ⋮ | ⋮ | ⋮ | ⋮ |
| 128 | 128 | 160 | 320 |

APPARATUS AND METHOD FOR CHECKING LOUDSPEAKER

CROSS-REFERENCE TO RELATED APPLICATIONS

The present application claims priority from Japanese Patent Application No. JP 2005-135645, filed on May 9, 2005, the disclosure of which is hereby incorporated by reference herein.

BACKGROUND OF THE INVENTION

The present invention relates to an apparatus and a method for checking loudspeakers of a playback apparatus.

A loudspeaker array is favorably used as a loudspeaker system in a home theater or an AV system. FIG. 13 shows an example of a loudspeaker array 10, which includes many loudspeakers SP1 to SPm arranged (loudspeaker unit). In this loudspeaker array 10, m=256 and the diameter of each loudspeaker is several centimeters, for example. Therefore, the loudspeakers SP1 to SPm are actually two-dimensionally arranged on a plane surface. However, the following description is given under the assumption that the loudspeakers SP1 to SPm are aligned in the horizontal direction for convenience.

Audio signals are supplied from a signal source SS to delay circuits DL1 to DLm, where the audio signals are delayed by predetermined times τ1 to τm, respectively, and the delayed audio signals are supplied to the loudspeakers SP1 to SPm through power amplifiers PA1 to PAm. The delay times τ1 to τm used in the delay circuits DL1 to DLm are described below.

Then, sound waves output from the loudspeakers SP1 to SPm are synthesized and a sound pressure as a synthesis result is obtained at any point. As shown in FIG. 13, in a sound field generated by the loudspeakers SP1 to SPm, predetermined points Ptg and Pnc are defined as follows:

Ptg: a point where the sound pressure is higher than that of any other points, that is, a point of enhanced sound pressure; and Pnc: a point where the sound pressure is lower than that of any other points, that is, a point of reduced sound pressure.

In this case, a method illustrated in FIG. 14 or 15 can be mainly used as a method for making an arbitrary point the point of enhanced sound pressure Ptg.

That is, in the method illustrated in FIG. 14, assume that

L1 to Lm: respective distances from the loudspeakers SP1 to SPm to the point of enhanced sound pressure Ptg; and that s: sound velocity.

The delay times τ1 to τm of the delay circuits DL1 to DLm are set as follows:

$$\tau 1=(Lm-L1)/s;$$

$$\tau 2=(Lm-L2)/s;$$

$$\tau 3=(Lm-L3)/s; \ldots \text{ and}$$

$$\tau m=(Lm-Lm)/s=0.$$

In this method, when the audio signals output from the signal source SS are converted to sound waves by the loudspeakers SP1 to SPm and are output therefrom, those sound waves are output while being delayed by the times τ1 to τm, respectively. Thus, all of those sound waves reach the point of enhanced sound pressure Ptg at the same time, so that the sound pressure at the point Ptg is higher than that of any other points.

In other words, in the method illustrated in FIG. 14, time differences occur among the sound waves due to variations in the paths from the loudspeakers SP1 to SPm to the point of enhanced sound pressure Ptg. However, the delay circuits DL1 to DLm compensate for the time differences so that the sound waves focus on the point of enhanced sound pressure Ptg.

In the method illustrated in FIG. 15, the delay times τ1 to τm of the delay circuits DL1 to DLm are set so that the phase wavefronts of progressive waves (sound waves) output from the loudspeakers SP1 to SPm match with each other. Accordingly, directivity is given to the sound waves and the sound waves are directed to the point of enhanced sound pressure Ptg. This system corresponds to the focus-type system shown in FIG. 14 in which the distances L1 to Lm are changed to infinite.

The following Patent Documents are cited as known arts: Patent Document 1 (Japanese Unexamined Patent Application Publication No. 9-233591) and Patent Document 2 (Japanese Unexamined Patent Application Publication No. 2004-172661).

SUMMARY OF THE INVENTION

As described above, the point of enhanced sound pressure Ptg can be freely set by using the loudspeaker array 10. However, the number of loudspeakers SP1 to SPm included in the loudspeaker array 10 is several tens to several hundred, and those loudspeakers SP1 to SPm operate at almost the same time during playback.

Thus, even if a failure occurs in any of the loudspeakers, for example, even if poor connection or disconnection of a voice coil occurs, the failure may not be detected. Furthermore, much time is required to specify or determine the broken loudspeaker.

The present invention has been made in view of these circumstances, and is directed to enabling quick and accurate check (determination) of whether each loudspeaker has a failure in a system using many loudspeakers, such as a loudspeaker array.

According to an embodiment of the present invention, a test tone signal is generated by adding first and second sinusoidal signals of different frequencies; a plurality of test tone signals are generated by varying the frequencies; the plurality of test tone signals are simultaneously supplied to a plurality of loudspeakers, respectively; frequency analysis is performed on an output signal from a microphone that picks up test tones output from the plurality of loudspeakers; and whether the respective loudspeakers are normal or abnormal is determined on the basis of a result of the frequency analysis.

With this configuration, whether the respective loudspeakers have a failure can be swiftly checked. Since the test tone contains a plurality of frequency components, the check can be accurately performed.

BRIEF DESCRIPTION OF THE DRAWINGS

FIG. 2 shows an example of a tone frequency list;

FIG. 3 shows an example of a tone sequence list;

FIG. 11 shows another example of the tone frequency list;

FIG. 12 shows another example of the tone sequence list;

DETAILED DESCRIPTION

<1> Outline of the Present Invention

In an embodiment of the present invention, test tone signals STT, each generated by mixing at least two sinusoidal signals Sa and Sb, are supplied to loudspeakers SP1 to SPm. The frequencies of the sinusoidal signals Sa and Sb in the respective test tone signals STT are different in the respective loudspeakers.

Then, test tones having frequency components corresponding to the test tone signals STT are output from the loudspeakers SP1 to SPm, and frequency analysis is performed on the output test tones. If a predetermined frequency component can be obtained, the loudspeaker that has output a test tone of the frequency component is determined to be normal. If the predetermined frequency component cannot be obtained, the loudspeaker that has output a test tone of the frequency component is determined to be abnormal. In this way, whether each loudspeaker has a failure is determined on the basis of a frequency component obtained through frequency analysis.

<2> Sinusoidal Signal

Figure 1:
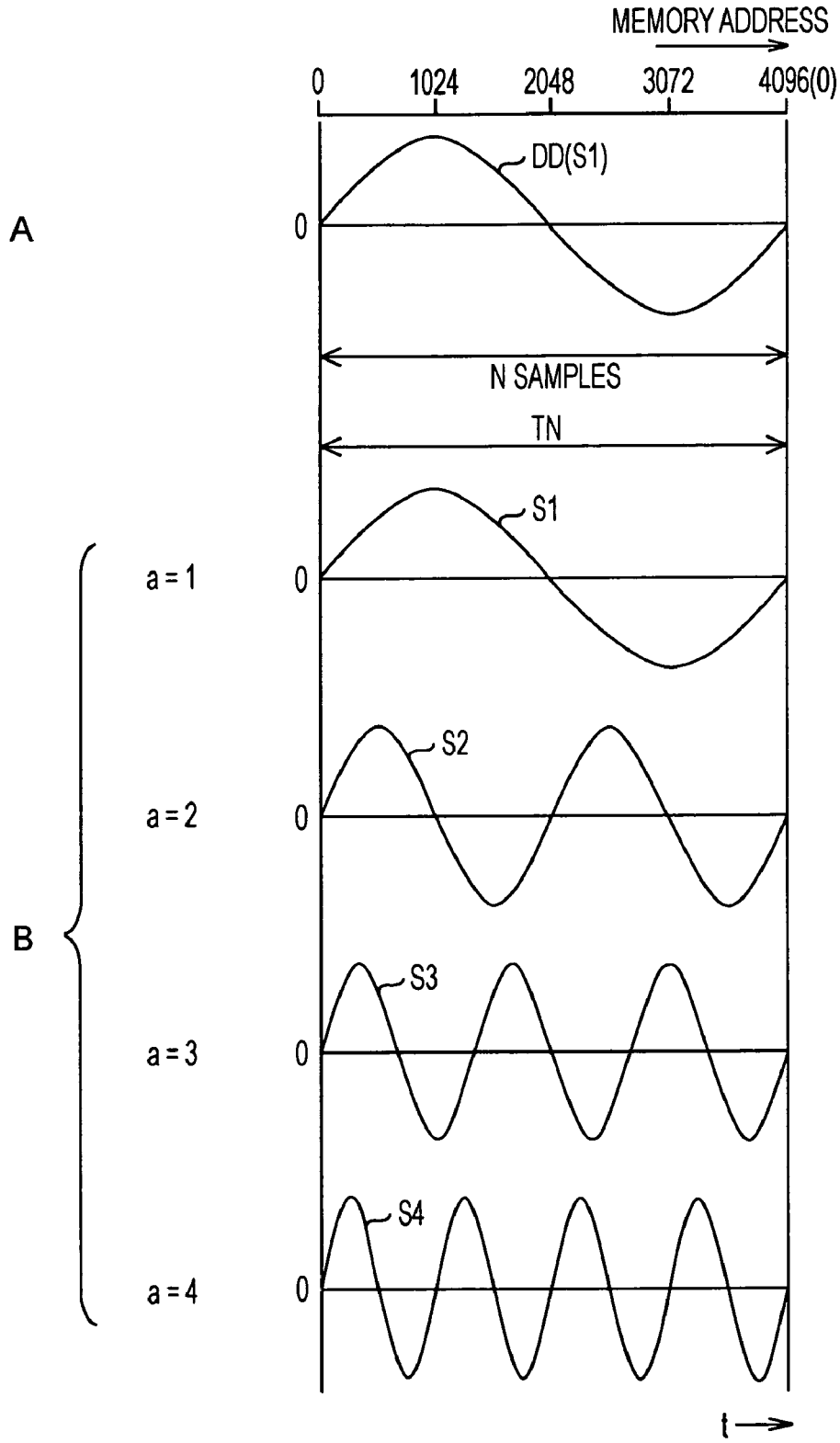
FIG. 1 is a waveform diagram illustrating an embodiment of the present invention.

Assume that, as shown in A in FIG. 1, digital data DD, which is to be D/A (digital to analog) converted to one cycle of a sinusoidal signal S1, is stored in a memory. In this case, the digital data DD corresponds to data that is obtained by sampling one cycle of the sinusoidal signal S1 into N samples, and thus one cycle is composed of N samples. Also, assume that N=power of 2 . . . (1), for example, N=4096.

The respective samples of the digital data DD are written in 0-th address to (N−1)-th address of the memory in a normal order. The digital data DD may be data of a typical format in digital audio, that is, data having a quantifying bit number of 16 bits and in a format of two's-complement numbers.

Additionally, assume that fS: clock frequency used to read the data DD from the memory;

f1: the frequency of the sinusoidal signal S1, f1=fs/N; and

TN: one cycle of the sinusoidal signal S1, TN=1/f1.

Under this condition, if fs=48 (kHz), $$f1 = fS/N \tag{2}$$

$$= 48000/4096 \approx 11.72(\text{Hz}).$$

Accordingly, if the digital data DD is sequentially read one sample by one from the respective addresses of the memory with the clock frequency fS, one cycle of a sinusoidal signal S1 having a frequency of 11.72 Hz (=f1) can be obtained in the time TN, as indicated as "a=1" in B in FIG. 1.

If the digital data DD is read from the memory every other address and if the reading is repeated twice, two cycles of a sinusoidal signal S2 having a double frequency 2f1 (=23.44 Hz) can be obtained in the time TN, as indicated as "a=2" in B in FIG. 1.

If the digital data DD is read from the memory every three addresses and if the reading is repeated three times, three cycles of a sinusoidal signal S3 having a triple frequency 3f1 (=35.16 Hz) can be obtained in the time TN, as indicated as "a=3" in B in FIG. 1.

Likewise, if the digital data DD is read from the memory every "a" addresses ("a" is a natural number) and if the reading is repeated "a" times, "a" cycles of a sinusoidal signal Sa having an a-fold frequency a·f1 can be obtained in the time TN.

Thus, if fa: frequency of a sinusoidal signal Sa obtained in the time TN, fa=f1×a=fS/N×a . . . (3) is satisfied on the basis of expression (2). A sinusoidal signal Sb having a frequency fb can be generated in the same way.

As in the above-described case where "a" cycles of the sinusoidal signal Sa are just included within the time TN, if frequency analysis is performed by FFT (Fast Fourier Transform) on the sinusoidal signal Sa, amplitude occurs only at the frequency fa of the sinusoidal signal Sa, and amplitude does not occur at any other frequencies. This is the same for the sinusoidal signal Sb. Therefore, when a test tone output from a loudspeaker to be checked is picked up to obtain sinusoidal signals Sa and Sb and when frequency analysis is performed on these signals Sa and Sb, window-function processing need not be performed, so that the frequency analysis can be easily performed.

Further, since the number N of samples in the memory is defined by expression (1), the memory can be efficiently used. For example, one cycle of the digital data DD can be obtained and the memory can be saved by reading the digital data DD in the following manner. The first ¼ cycle of the digital data DD is prepared in the memory. During reading of the digital data DD, the data is read in the normal order of address in the first ¼ cycle, the data is read in the reverse order in the second ¼ cycle, the data is read in the same manner in the third and fourth ¼ cycles, and then the polarity of the read data is inverted. Alternatively, the digital data DD can be data sequence of a cosine wave signal instead of the sinusoidal signal S1.

In the following description, the above-described specific values N=4096 and fS=48 kHz are used.

<3> Tone Frequency List

A "tone frequency list" is a list (or table) to define the frequencies of sinusoidal signals Sa and Sb included in respective test tone signals STT. FIG. 2 shows an example of the tone frequency list. In the list shown in FIG. 2, 128 types of test tone signals STT can be used.

In this tone frequency list, a first column shows pattern numbers PN to identify the respective 128 types of test tone signals STT. In this example, PN=1 to 128. Second and third columns show frequencies a and b of sinusoidal signals Sa and Sb included in the respective test tone signals STT.

For example, in the row of PN=1, a=100 and b=740. Thus, the test tone signal STT of PN=1 is composed of sinusoidal signals S100 and S740. At this time, the frequencies f100 and f740 of the sinusoidal signals S100 and S740 can be defined in the following expressions based on expression (3):

$$f100=48000/4096\times100\approx1171.9\ (\text{Hz});\ \text{and}$$

$$f740=48000/4096\times740\approx8671.9\ (\text{Hz}).$$

The test tone signal STT of PN=128 is composed of sinusoidal signals S735 and S1375. At this time, the frequencies f735 and f1375 can be defined in the following expressions:

$$f735=48000/4096\times735\approx8623.3\ (\text{Hz});\ \text{and}$$

$$f1375=48000/4096\times1375\approx16113.3\ (\text{Hz}).$$

As can be understood from this tone frequency list, the frequencies fa and fb of sinusoidal signals Sa and Sb are different in the respective test tone signals STT.

<4> Tone Sequence List

A "tone sequence list" is a list (or table) showing the correspondence between the loudspeakers SP1 to SPm and the pattern numbers PN of the test tone signals STT supplied thereto. FIG. 3 shows an example of the tone sequence list. In the list shown in FIG. 3, the number of loudspeakers SP1 to SPm is 128 (m=128).

In this case, 128 types (PN=1 to 128) of test tone signals STT are simultaneously supplied to the 128 loudspeakers SP1 to SP128 so that a failure in the loudspeakers SP1 to SP128 can be checked in a short time.

Note that, a frequency characteristic of loudspeakers typically has a peak and a dip. Due to the dip, a loudspeaker supplied with a test tone signal STT may not output a predetermined test tone, and thus a test tone may not be picked up. This phenomenon may be misinterpreted as a failure of the loudspeaker.

In view of such inconvenience, the test tone signals STT are supplied to the loudspeakers SP1 to SP128 three times in the tone sequence list shown in FIG. 3. More specifically, in the tone sequence list shown in FIG. 3, a first column shows loudspeaker numbers SN assigned to the loudspeakers SP1 to SPm. In this example, m=128 and thus SN=1 to 128. Second to fourth columns show pattern numbers PN of the test tone signals STT to be supplied to the loudspeakers SP1 to SP128 at the first time (SEQ=1) to the third time (SEQ=3), respectively.

At the first supply, the test tone signals STT of PN=1 to 128 are simultaneously supplied to the loudspeakers SP1 to SP128, as shown in the column "FIRST" in FIG. 3. At the second supply, the test tone signals STT of PN=33 to 128 and PN=1 to 32 are simultaneously supplied to the loudspeakers SP1 to SP96 and SP97 to SP128, as shown in the column "SECOND" in FIG. 3. At the third supply, the test tone signals STT of PN=65 to 128 and PN=1 to 64 are simultaneously supplied to the loudspeakers SP1 to SP64 and SP65 to SP128, as shown in the column "THIRD" in FIG. 3.

In this method, the frequency components of the test tone signals STT supplied to the loudspeakers SP1 to SP128 are different from each other, and thus the frequency components of test tones output from the loudspeakers SP1 to SP128 are different from each other. Therefore, whether the respective loudspeakers SP1 to SP128 have a failure can be determined by performing frequency analysis on test tones output from the loudspeakers SP1 to SP128 and checking frequency components as the analysis result.

Since the test tone signals STT are simultaneously supplied to the 128 loudspeakers SP1 to SP128, whether the respective loudspeakers SP1 to SP128 have a failure can be checked in a short time. Further, as shown in FIG. 3, check is repeatedly performed as necessary and the frequency components of the test tone signals STT supplied to the loudspeakers SP1 to SP128 are changed in each check. Thus, whether the respective loudspeakers have a failure can be accurately checked even if the frequency characteristic of the loudspeakers SP1 to SP128 has a dip.

<5> Format of Test Tone Signal STT

Figure 4:
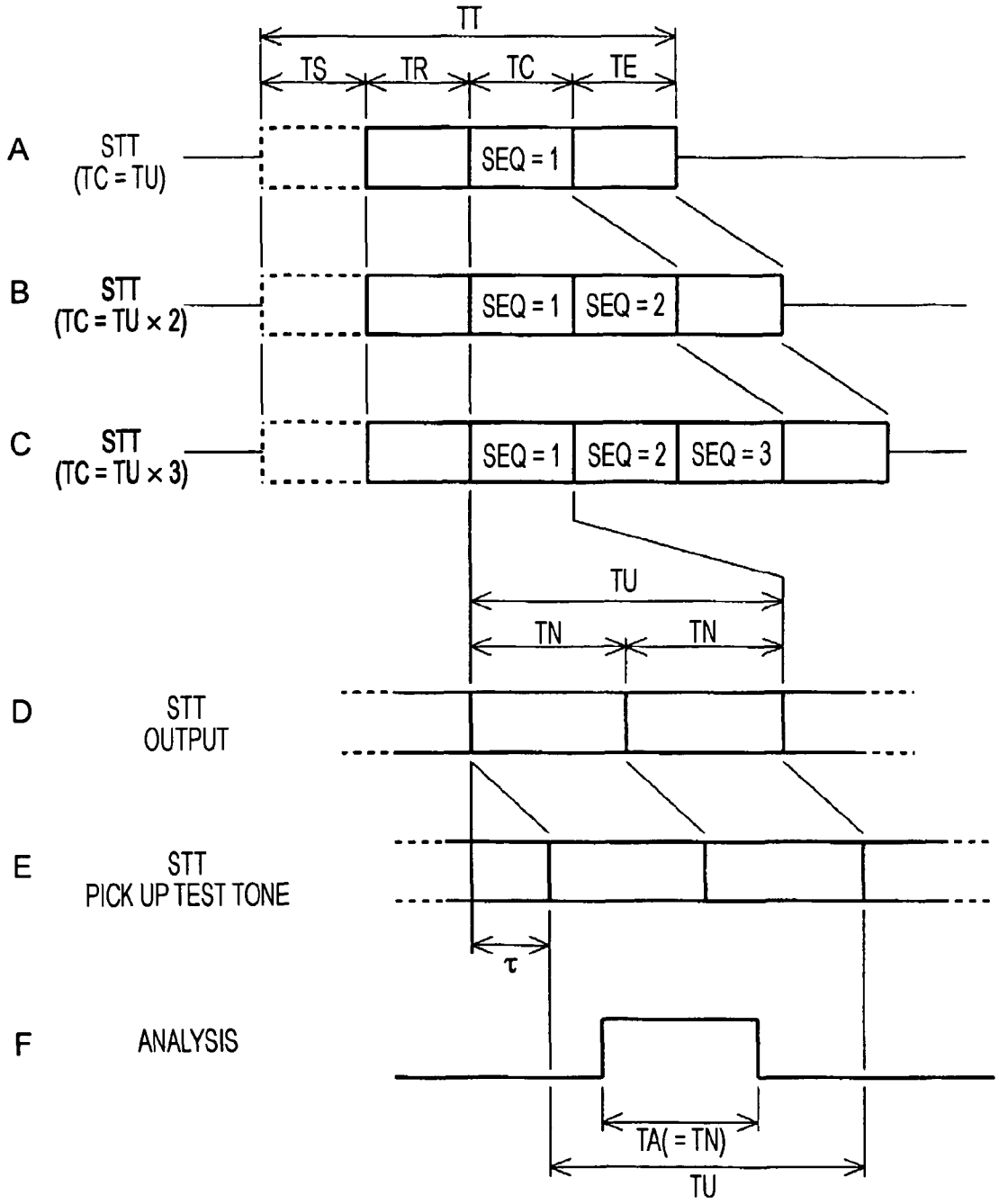
FIG. 4 is a timing chart illustrating an embodiment of the present invention.

"A" in FIG. 4 shows a format (timing chart) of one channel of a test tone signal STT. The test tone signal STT is generated and is supplied to a predetermined loudspeaker during a test time TT. The test time TT is composed of a silent time TS, a readiness time TR, a check time TC, and an end time TE.

Herein, the silent time TS is a time for measuring dark noise (background noise) of a room where the loudspeakers SP1 to SPm are set, and a test tone signal STT is idle during this time. The readiness time TR is a time for setting an appropriate volume of a test tone to be output from each loudspeaker during the following check time TC. The check time TC is a time for actually checking whether the loudspeakers SP1 to SPm have a failure. The end time TE is a time used to end the test tone and is not used to check whether the loudspeakers have a failure.

In A of FIG. 4, each of the times TS, TR, TC, and TE is composed of a single unit time TU. Note that, the check time TC is basically composed of a single unit time TU but is composed of two or three unit times TU when check of the loudspeakers SP1 to SPm is repeated, as shown in B and C in FIG. 4.

As shown in D in FIG. 4 (the time axis is extended in D, E, and F of FIG. 4), the unit time TU is equal to 2×TN shown in FIG. 1. When a plurality of test tone signals STT are simultaneously supplied to the loudspeakers SP1 to SPm, the content thereof is changed in the unit time TU.

Herein, the test tone signal STT is a composite signal composed of sinusoidal signals Sa and Sb, as described above. Since the numbers a and b of cycles of the signals Sa and Sb in the time TN are natural numbers, the phase of the test tone signal STT smoothly changes at the border between the times TN and TN in the unit time TU.

In the case of the above-described values, $$TU=TN\times2=4096/48000\times2\approx171\ (\text{msec}).$$

In the case of A in FIG. 4, $$TT=TS+TR+TC+TE=TU\times4{,}683\ (\text{msec}).$$

When such a test tone signal STT is supplied to a loudspeaker to be checked, the loudspeaker outputs a test tone having a frequency component corresponding to the test tone signal STT if the loudspeaker is normal.

After the test tone output from the loudspeaker is picked up by a microphone, the microphone outputs a test tone signal STT as shown in E in FIG. 4 (hereinafter, the test tone signal STT output from the microphone is called a "response signal STT"). The response signal STT delays by time $\tau$ with respect to the test tone signal STT (D in FIG. 4) supplied to the loudspeaker, the time τ corresponding to the distance between the loudspeaker and the microphone.

Thus, as shown in F in FIG. 4, whether the loudspeaker has a failure can be checked by performing frequency analysis on the response signal STT from the microphone over a predetermined time TA.

As shown in E in FIG. 4, in the response signal STT from the microphone, the same content is repeated twice during the times TN and TN in the unit time TU, and thus the time position of the analysis time TA has a sufficient allowance. Therefore, after the response signal STT has been output from the microphone, frequency analysis of the response signal STT can be started with the rising edge of the output signal being the reference of the check time TC, and thus the delay time τ of the picked up response signal STT need not be considered so much.

Since the test tone signal STT is a composite signal composed of sinusoidal signals Sa and Sb, the number of cycles of the response signal STT in the analysis time TA is an integer if the analysis time TA is equal to TN. Therefore, window-function processing need not be performed in frequency analysis, so that the frequency analysis can be simplified.

If no test tone is output from a loudspeaker during the check time TC (=TU) shown in A in FIG. 4, the check time TC is extended as shown in B or C in FIG. 4, and the frequencies of the sinusoidal signals Sa and Sb in the test tone signal STT supplied to the loudspeaker are changed as shown in FIG. 3. In this method, if no test tone is output from a loudspeaker, the cause can be correctly determined: due to a failure of the loudspeaker or a dip of the frequency characteristic. Accordingly, whether the respective loudspeakers have a failure can be reliably determined.

<6> Method for Determining Dark Noise (Background Noise) and Failure in Loudspeakers As shown in FIG. 4, the silent time TS at the top of the test time TT is used to avoid an affection of dark noise on checking failure of the loudspeakers. When test tones output from the loudspeakers are picked up and a response signal STT obtained thereby is analyzed in order to measure the levels of respective frequency components of the test tones, the analysis result (frequency components) contains frequency components of dark noise.

For this reason, frequency components of dark noise need to be considered when a failure of the loudspeakers is determined on the basis of the analysis result of the test tones. Hereinafter, an example of a determining method considering dark noise is described.

First, dark noise in the silent time TS is picked up and frequency analysis is performed thereon. As shown in FIG. 5B, for example, the levels of respective frequency components (noise components) are obtained and the levels are stored. At this time, only the levels of components having the same frequencies as those of the sinusoidal signals Sa and Sb in the test tone signal STT are to be stored. The levels of the other frequency components need not be stored. The frequencies of the sinusoidal signals Sa and Sb can be known by referring to the tone frequency list.

Figure 5A:
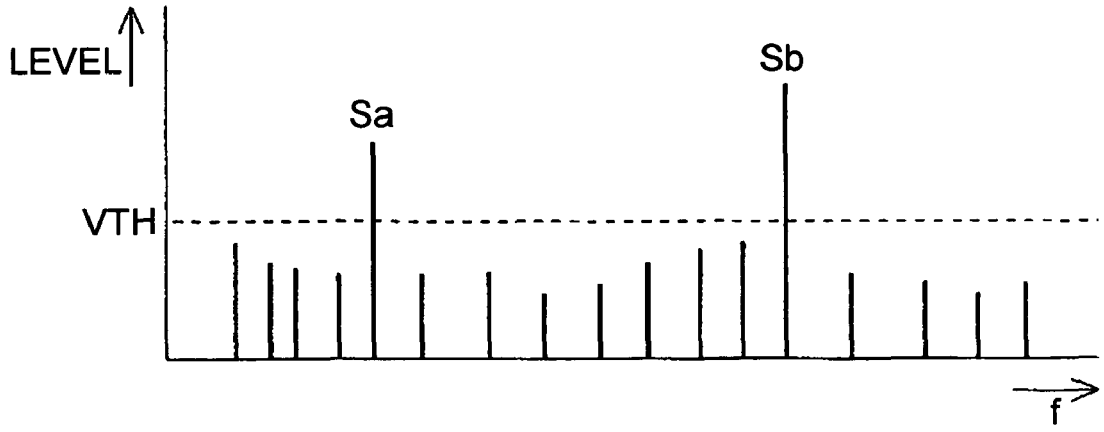
FIGS. 5A and 5B show frequency spectrums according to an embodiment of the present invention.
Figure 5B:
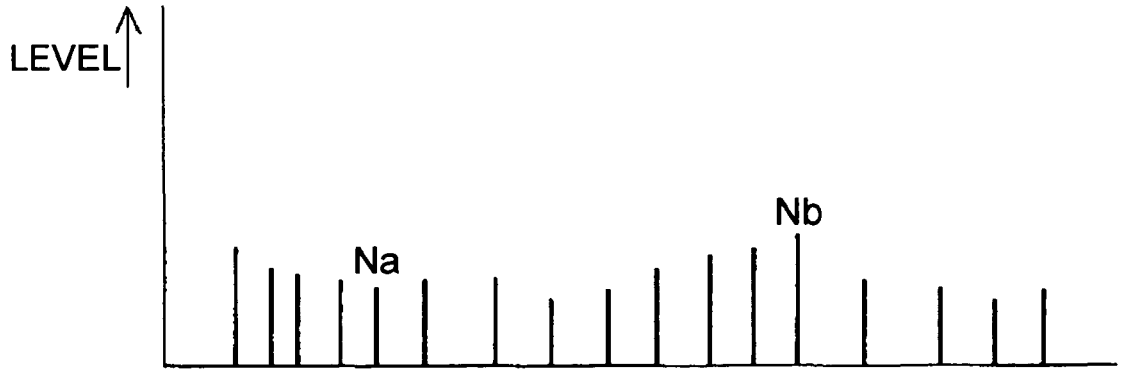

Then, in the check time TC, the test tone signal STT is supplied to the loudspeaker to be checked, frequency analysis is performed on a response signal STT output from the loudspeaker, and the levels of respective frequency components are obtained, as shown in FIG. 5A. In FIG. 5A, the signals Sa and Sb are frequency components obtained from the loudspeaker to be checked, and the other frequency components are caused by dark noise. Typically, the levels of the signals Sa and Sb vary depending on the frequency characteristic of a loudspeaker, and the signals Sa and Sb contain frequency components of dark noise.

Then, the S/N (signal to noise) ratio between the signal Sa and a noise component Na having a frequency equal to that of the signal Sa among the noise components whose levels are stored (FIG. 5B) is calculated, and the S/N ratio is regarded as a value Va. Also, the S/N ratio between the signal Sb and a noise component Nb having a frequency equal to that of the signal Sb among the noise components is calculated, and the S/N ratio is regarded as a value Vb. If the level of any of the signals Sa and Sb does not reach a predetermined value VTH, the S/N ratio is not calculated and the corresponding value is set to 0.

In the values Va and Vb, a value Vx (x is one of a and b) having the higher S/N ratio is selected, and this maximum value Vx is compared with a predetermined value VREF. Then, determination is made in the following manner:

(i) if Vx>VREF, the checked loudspeaker is normal; and (ii) if Vx≦VREF, the checked loudspeaker has a failure.

In this way, whether the loudspeaker has a failure is determined by comparing the predetermined value VREF with the S/N ratio of a signal having the most favorable S/N ratio among the signals Sa and Sb in the picked up response signal STT. Therefore, the determination can be accurately made while avoiding the affection of the frequency characteristic of the loudspeaker or the standing-wave characteristic of a room.

<7> Sound-Field Correcting Apparatus

Figure 6:
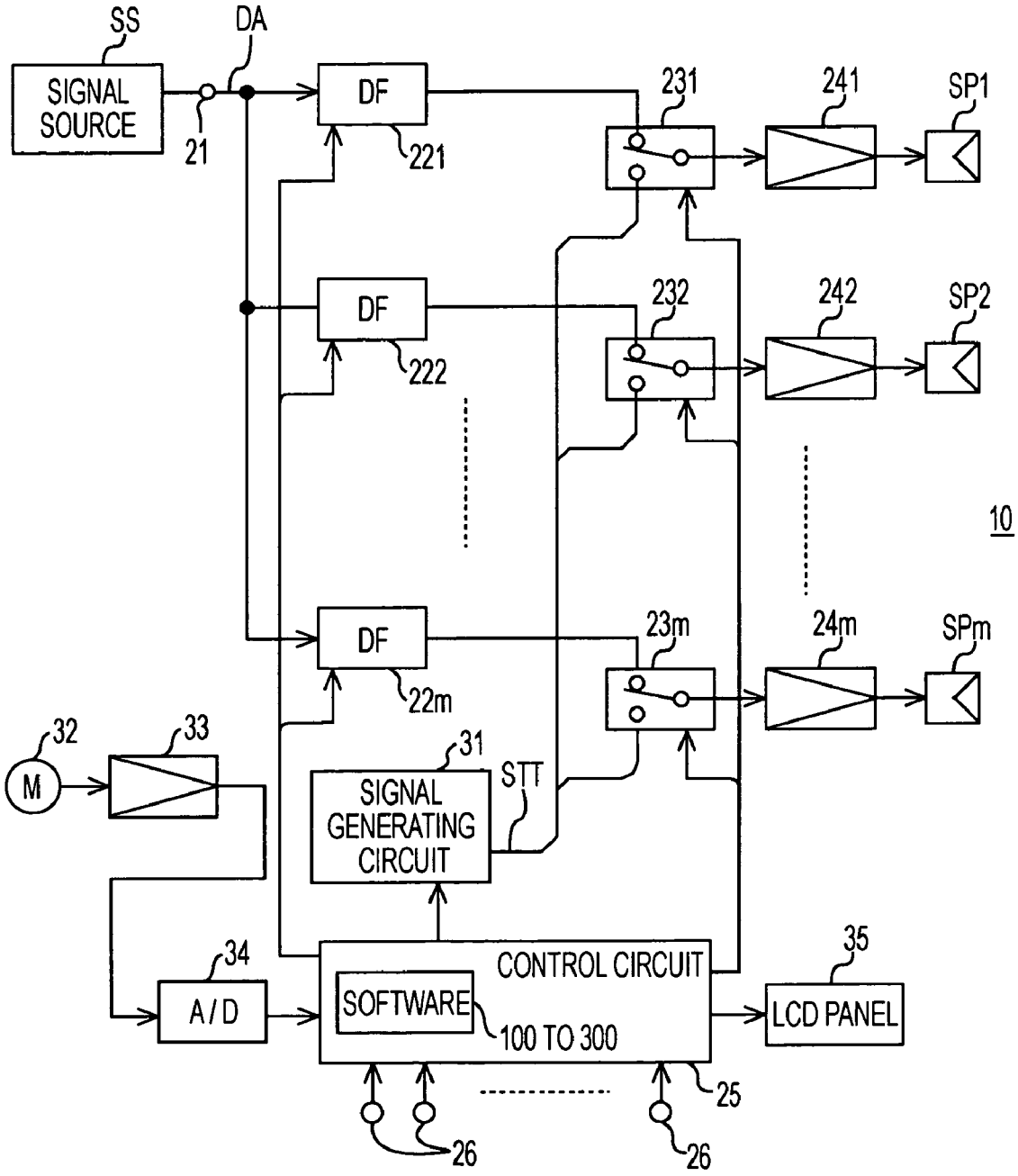
FIG. 6 is a systematic diagram showing a sound-field correcting apparatus according to an embodiment of the present invention.

FIG. 6 shows an example in which the present invention is applied to a sound-field correcting apparatus. In this example, m=128.

<7-1> Configuration and Operation of the Sound-Field Correcting Apparatus

Digital audio signals DA are output from a signal source SS of a DVD player, a digital tuner, or a game machine, and the digital audio signals DA are supplied to digital filters 221 to 22*m* (m=128) through an input terminal 21.

Figure 13:
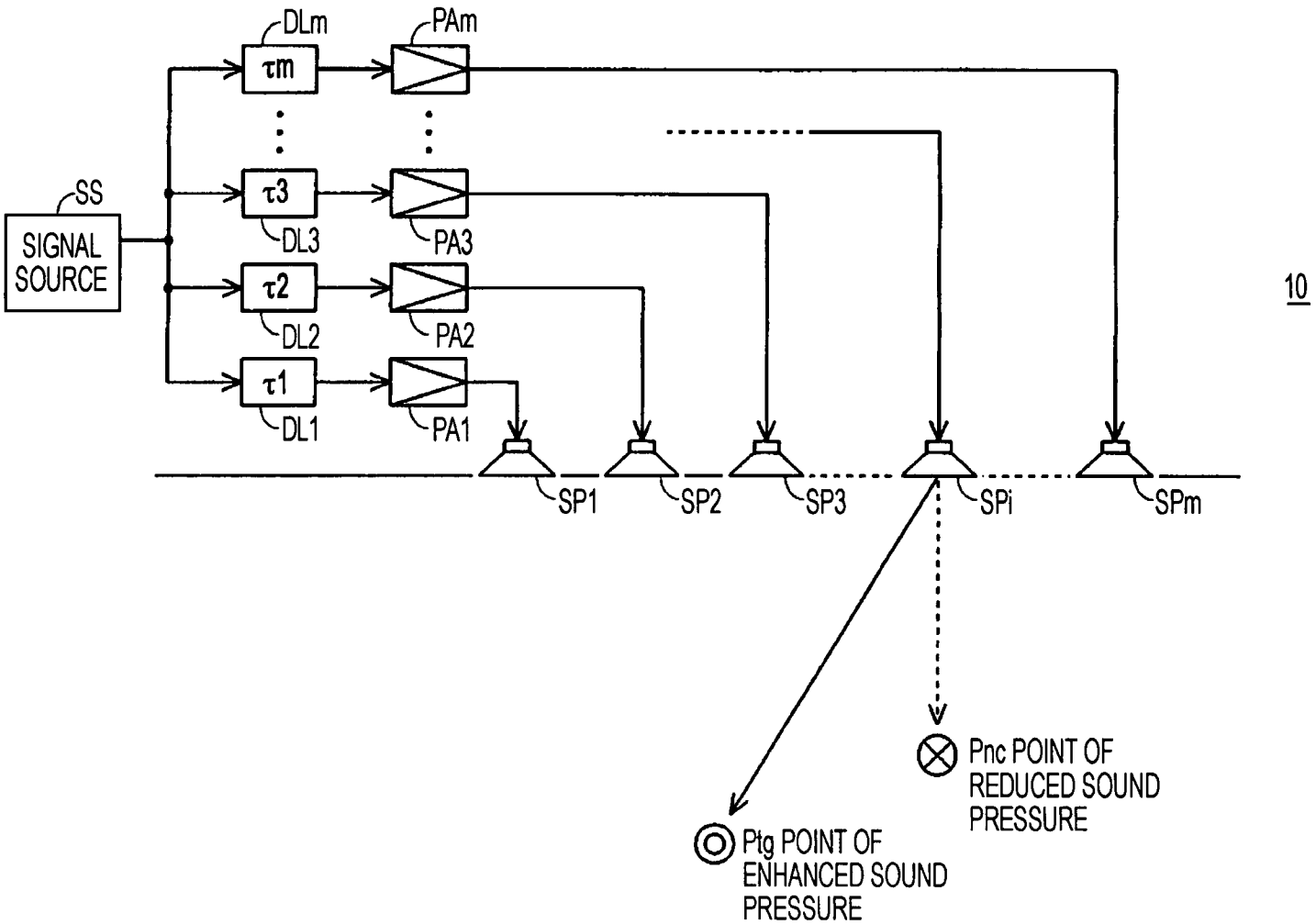
FIG. 13 shows an example of a known loudspeaker array.
Figure 14:
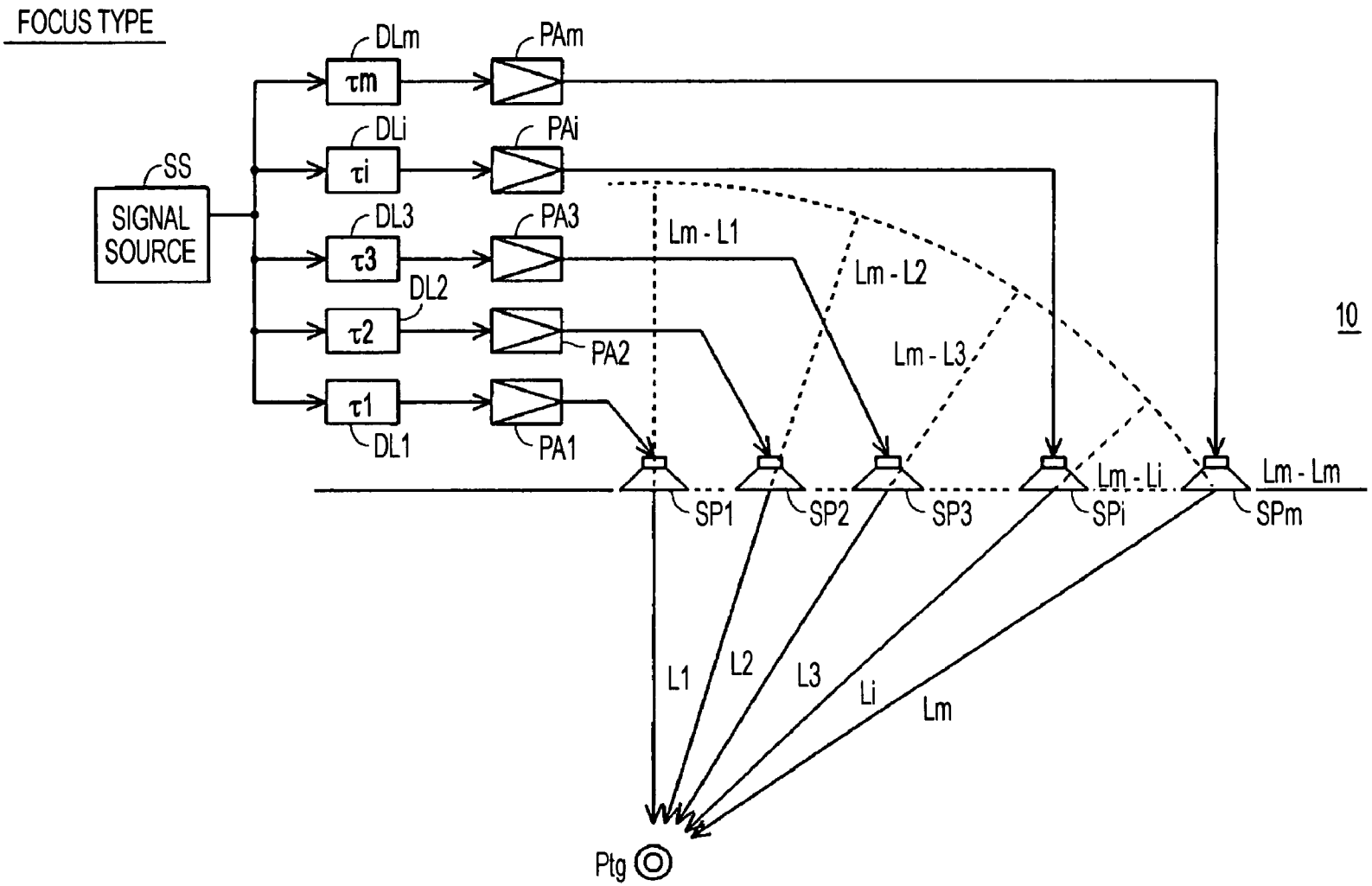
FIG. 14 illustrates a method for making an arbitrary point a point of enhanced sound pressure.
Figure 15:
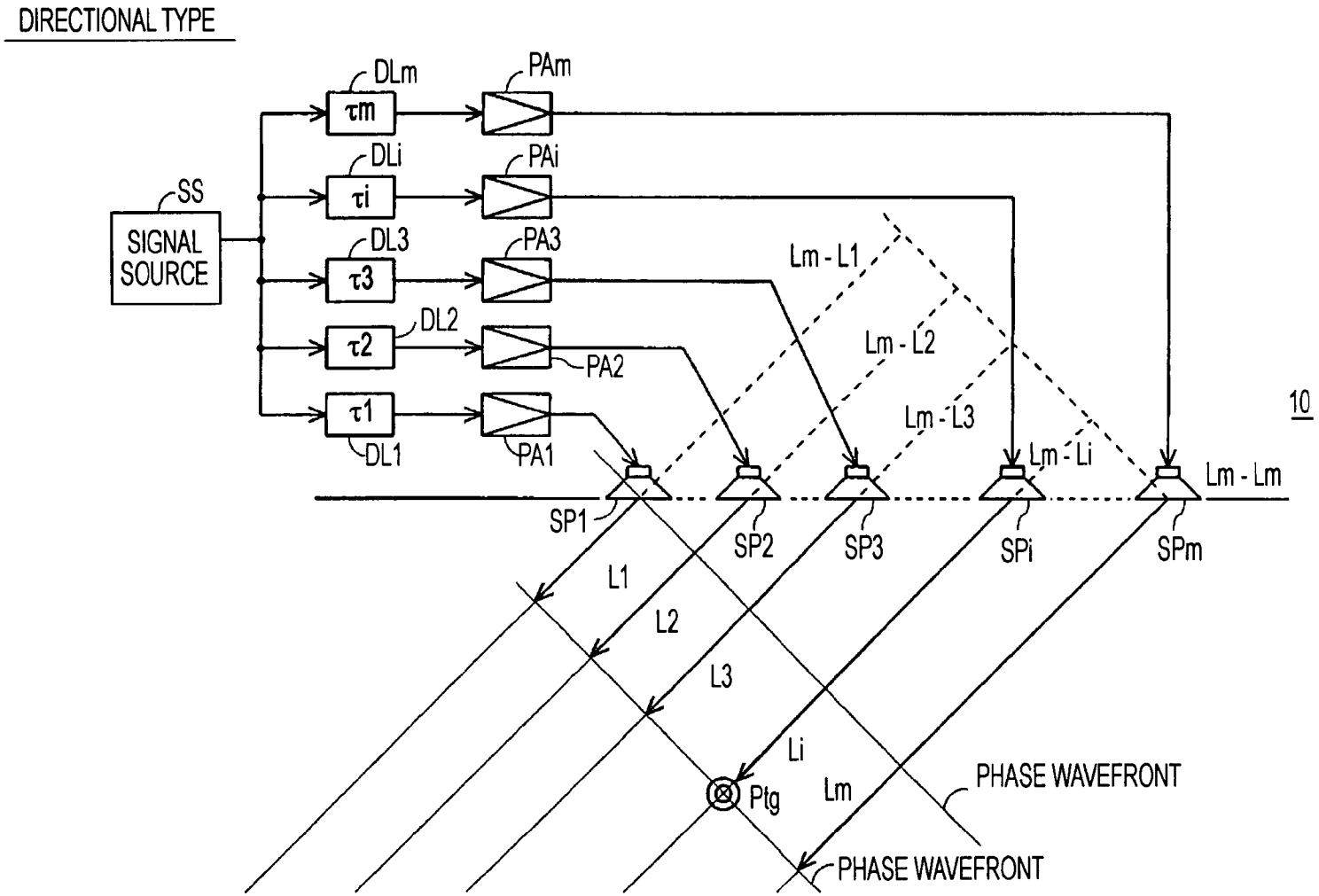
FIG. 15 illustrates another method for making an arbitrary point a point of enhanced sound pressure.

The format of each digital audio signal DA is the same as that of the digital data DD of the sinusoidal signal S1. The digital filters 221 to 22*m* perform a delay process as the delay circuits DL1 to DLm shown in FIG. 13 and also perform sound-field correction as necessary. Accordingly, digital audio signals to generate the point of enhanced sound pressure Ptg as shown in FIG. 14 or 15 are output from the digital filters 221 to 22*m*.

Then, the digital audio signals are supplied to digital amplifiers 241 to 24*m* through switching circuits 231 to 23*m*. In this example, the digital amplifiers 241 to 24*m* are so-called class D amplifiers, and perform class D power amplification on the supplied digital audio signals by switching so as to output analog audio signals of respective channels.

Then, the audio signals output from the digital amplifiers 241 to 24*m* are supplied to loudspeakers SP1 to SPm, respectively. In this example, the loudspeakers SP1 to SPm form the loudspeaker array 10, as described above. For example, the loudspeakers are arranged in line as shown in FIG. 13 or in rows×columns in front of a listener. Although not shown in the figure, the loudspeakers SP1 to SPm are accommodated in a cabinet.

Further, a control circuit 25 is provided. The control circuit 25 includes a microcomputer and sets delay times τ1 to τm in accordance with the point of enhanced sound pressure Ptg (or the point of reduced sound pressure Pnc), the delay times τ1 to τm being used by the digital filters 221 to 22*m* to delay digital audio signals DA. Thus, control signals to control the delay times τ1 to τm are supplied from the control circuit 25 to the digital filters 221 to 22*m*.

Also, control signals are supplied from the control circuit 25 to the switching circuits 231 to 23*m*. The switching circuits 231 to 23*m* are connected in the manner shown in FIG. 6 during a normal playback, but are connected in the opposite manner while a failure of the loudspeakers SP1 to SPm is being checked. Further, various operation switches 26 are connected to the control circuit 25.

With this configuration, digital audio signals DA from the signal source SS are supplied to the loudspeakers SP1 to SPm through signal lines including the digital filters 221 to 22*m*; the switching circuits 231 to 23*m*; and the digital amplifiers 241 to 24*m*, during a normal playback. At this time, the predetermined delay times τ1 to τm are given to the digital audio signals DA in the digital filters 221 to 22*m*, so that the point of enhanced sound pressure Ptg is generated and the position thereof is controlled.

<7-2> Configuration for Checking Failure in Loudspeakers

Whether the loudspeakers SP1 to SPm have a failure is checked in the following configuration. A signal generating circuit 31 to generate test tone signals STT includes a digital signal processor (DSP) or the like. Control signals to control the frequencies fa and fb of the sinusoidal signals Sa and Sb in the respective test tone signals STT are supplied from the control circuit 25 to the signal generating circuit 31.

The control circuit 25 performs frequency analysis on test tones output from the loudspeakers SP1 to SPm during the above-described analysis time TA and determines a failure in the loudspeakers SP1 to SPm in accordance with the analysis result. For this purpose, the control circuit 25 has routines 100, 200, and 300 shown in FIGS. 7 to 9, which are programs executed by the microcomputer in the control circuit 25.

Figure 7:
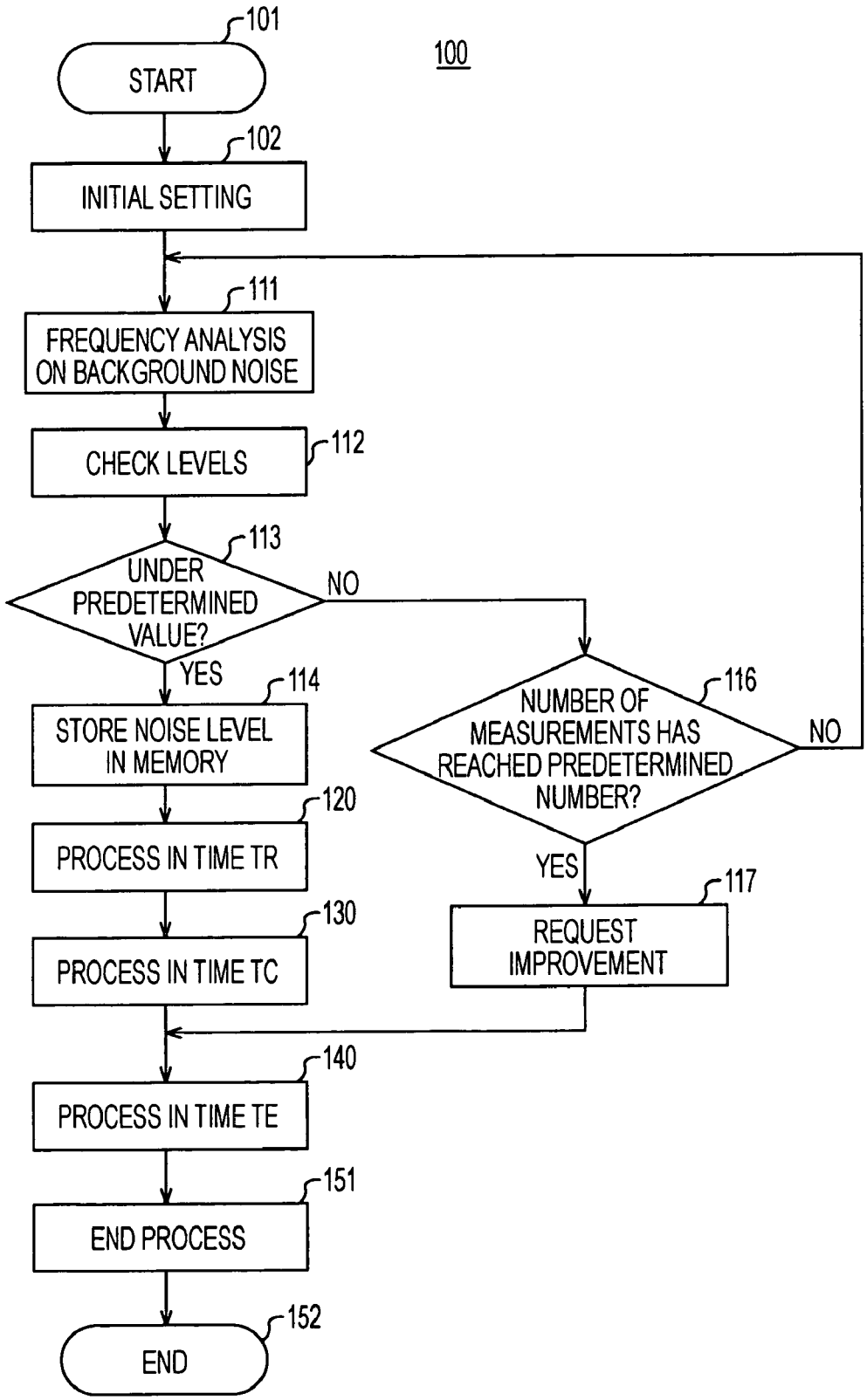
FIG. 7 is a flowchart of a routine performed by the apparatus shown in FIG. 6.
Figure 8:
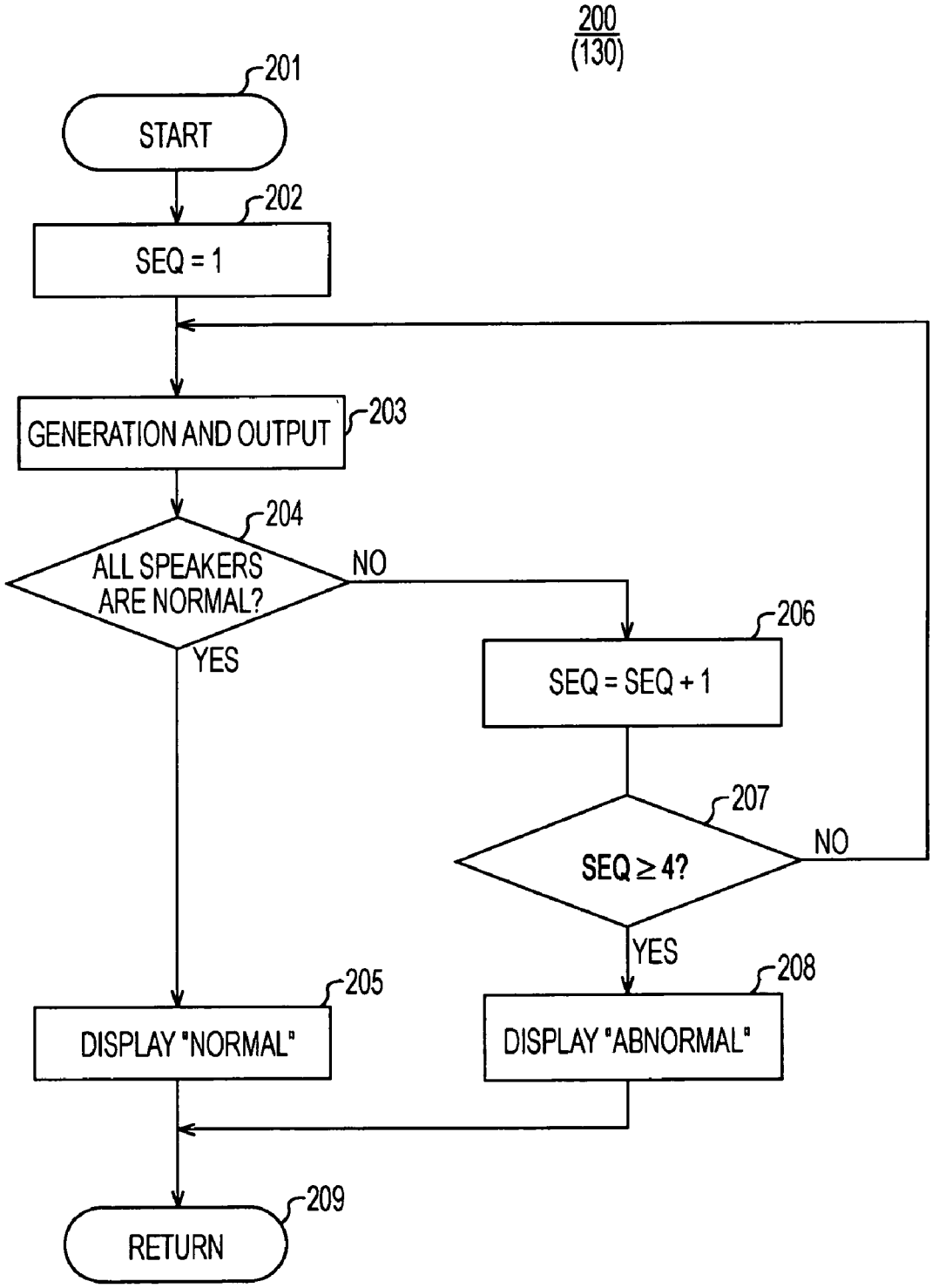
FIG. 8 is a flowchart showing the details of part of the routine shown in FIG. 7.
Figure 9:
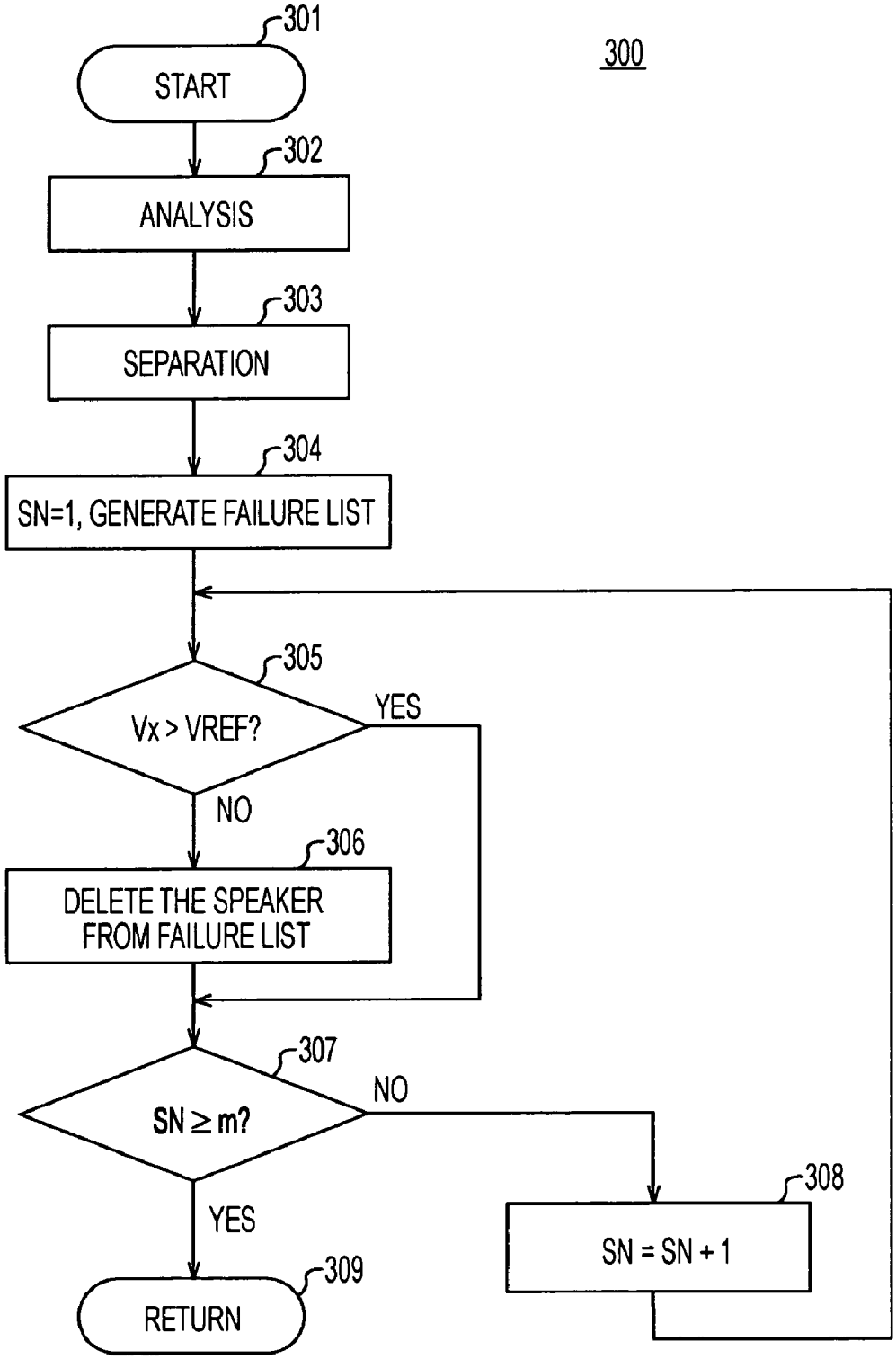
FIG. 9 is a flowchart of a routine performed by the apparatus shown in FIG. 6.

These routines 100 to 300 are described below in detail. FIGS. 7 to 9 show the part related to the present invention. After test tone signals STT are generated by the signal generating circuit 31 under control by the control circuit 25, the test tone signals STT are supplied to the switching circuits 231 to 23*m* and the switching circuits 231 to 23*m* are connected to the signal generating circuit 31.

A microphone 32 picks up test tones output from the loudspeakers SP1 to SPm. A response signal STT output from the microphone 32 is supplied through a microphone amplifier 33 to an A/D (analog to digital) converter 34, which A/D converts the response signal STT to a digital response signal STT, and the digital response signal STT is supplied to the control circuit 25.

The microphone 32 can be provided in the cabinet which accommodates the loudspeakers SP1 to SPm. The control circuit 25 connects to a LCD (liquid crystal display) panel 35, which is a display device to display a determination result of a failure in the loudspeakers SP1 to SPm.

<7-3> Operation of Checking Failure in Loudspeakers

Upon operation on a check switch among the operation switches 26, the microcomputer included in the control circuit 25 starts the routine 100 from step 101. Initial setting is done in step 102, so that the switching circuits 231 to 23*m* are connected in the manner opposite to that shown in the FIG. 6. Also, generation of test tone signals STT starts and a test time TT starts.

In the test time TT, the levels of dark noise in a silent time TS are measured in steps 111 to 114. That is, dark noise is picked up by the microphone 32, and a signal of the picked up dark noise is supplied to the control circuit 25 through the amplifier 33 and the A/D converter 34.

In step 111, frequency analysis based on FFT is performed on the signal of the dark noise (FIG. 5B), and the levels of respective frequency components of the dark noise are stored. The levels stored at this time are those of components having frequencies equal to those of the signals Sa and Sb in the test tone signal STT. The frequencies of the signals Sa and Sb can be referred to in the tone frequency list (FIG. 2).

Then, in step 112, the levels of the frequency components analyzed and stored in step 111 are compared with a predetermined noise level.

In step 113, the comparison result made in step 112 is checked. If all of the noise levels are lower than the predetermined noise level, the process proceeds from step 113 to step 114. In step 114, among the noise levels of the frequency components analyzed in step 111, the noise levels of components whose frequencies are equal to those of the signals Sa and Sb in the test tone signal STT are stored in a memory of the control circuit 25.

Then, the process proceeds from step 114 to step 120, where a process in the readiness time TR is executed. That is, the signal generating circuit 31 generates test tone signals STT, which are supplied to the loudspeakers SP1 to SPm through signal lines including the switching circuits 231 to 23*m* and the digital amplifiers 241 to 24*m*.

The test tone signals STT generated in the readiness time TR are the test tone signals STT having the pattern numbers PN shown in FIG. 2. These test tone signals STT can be supplied to the loudspeakers SP1 to SPm, respectively, in the combination shown in the column "FIRST" in FIG. 3, for example. Accordingly, test tones are simultaneously output from the loudspeakers SP1 to SPm during the readiness time TR.

The test tones output during the readiness time TR are used to adequately set the output levels of the loudspeakers SP1 to SPm in the following check time TC. Thus, the levels of the test tones are relatively low but can be set while considering the analysis result of the dark noise in the previous silent time TS. Further, the test tones output in the readiness time TR are picked up by the microphone 32, a response signal STT corresponding to the picked up test tone is supplied to the control circuit 25, and then the levels of the test tone signals STT used in the following check time TC are set.

Then, in step 130, a process in the check time TC is executed, as described below. Then, in step 140, a process in the end time TE is executed. That is, test tone signals STT for end are generated by the signal generating circuit 31 under control by the control circuit 25, and these signals STT are supplied to the loudspeakers SP1 to SPm.

Then, in step 151, generation of test tone signals STT ends, the switching circuits 231 to 23*m* are connected in the manner shown in FIG. 6, and the test time TT ends. In step 152, the routine 100 completes.

If there is a noise component (frequency component) whose level is higher than the predetermined noise level in step 113, the process proceeds from step 113 to step 116, where whether the number of measurements of dark noise levels (measurements in the silent time TS) has reached a predetermined number is checked. If the number has not reached the predetermined number, the process returns to step 111. Then, the silent time TS is repeated and the levels of frequency components of dark noise are measured again in the following steps.

If the number of measurements has reached the predetermined number in step 116, the process proceeds to step 117, where instructions to improve the environment and reduce dark noise is displayed in the LCD panel 35. Then, the process proceeds to step 152 through step 140, so that the routine 100 completes.

The process in the check time TC in step 130 is executed in the manner shown in the routine 200 in FIG. 8. Specifically, in the check time TC, the microcomputer included in the control circuit 25 starts the routine 200 from step 201. In step 202, a variable SEQ indicating any of "FIRST" to "THIRD" of the tone sequence list shown in FIG. 3 is set to 1.

In step 203, test tone signals STT having the pattern numbers PN shown in FIG. 2 are generated in accordance with the combination shown in the column indicated by the variable SEQ (the column "FIRST" in this case) of the tone sequence list shown in FIG. 3, and these signals STT are simultaneously supplied to the loudspeakers SP1 to SPm. Accordingly, test tones are output from the loudspeakers SP1 to SPm during the check time TC.

The test tones are picked up by the microphone 32, a response signal STT to the test tones is supplied to the control circuit 25, and frequency analysis is performed on the response signal STT during the above-described analysis time TA. Based on the analysis result, whether the respective loudspeakers SP1 to SPm have a failure is determined. The frequency analysis and determination of failure in the respective loudspeakers SP1 to SPm are executed in accordance with the routine 300.

Then, the determination result made in the routine 300 is checked in step 204. If all of the loudspeakers SP1 to SPm are normal, the process proceeds from step 204 to step 205, where a message saying that all of the loudspeakers SP1 to SPm are normal is displayed on the LCD panel 35. Then, the routine 200 completes in step 209, and the process proceeds to step 140 of the routine 100.

If it is determined in step 204 that any of the loudspeakers SP1 to SPm has not output a test tone, the process proceeds from step 204 to step 206, where the variable SEQ is incremented by one. Then, in step 207, it is determined whether the variable SEQ is 4 or more.

If the variable SEQ is less than 4, the process returns from step 207 to step 203, and the subsequent steps are repeated. In other words, the check time TC is repeated.

Note that, since the variable SEQ is incremented every time step 206 is executed, the combination of the test tone signals STT having the pattern numbers PN shown in FIG. 2 is changed to that shown in the column "SECOND" or "THIRD" in the tone sequence list shown in FIG. 3 every time step 203 and thereafter are repeated. Accordingly, the loudspeakers SP1 to SPm output test tones of different frequency components in each check time TC.

After a second or third check has been done, if all of the loudspeakers SP1 to SPm are determined to be normal, the process proceeds from step 204 to step 205, where a message saying that all of the loudspeakers SP1 to SPm are normal is displayed on the LCD panel 35. Then, the routine 200 completes in step 209, and the process proceeds to step 140 of the routine 100.

If any of the loudspeakers SP1 to SPm does not output a test tone at the third check, the process proceeds to step 206. Since SEQ≧4, the process proceeds from step 207 to step 208, where the loudspeaker number of an abnormal loudspeaker is displayed on the LCD panel 35. Then, the routine 200 completes in step 209, and the process proceeds to step 140 of the routine 100.

In addition to the above-described process, the control circuit 25 executes the routine 300 in parallel with the routine 100 during the analysis time TA so as to determine failure in the respective loudspeakers SP1 to SPm. In the routine 300, the process starts from step 301. In step 302, a response signal STT output from the A/D converter 34 is input to the control circuit 25 and frequency analysis is performed thereon in the analysis time TA. Then, frequency components analyzed in step 302 are separated for the corresponding loudspeakers in step 303. This separation is performed while the tone frequency list and the tone sequence list are referred to.

In step 304, the loudspeaker number SN (FIG. 3) is set to "1" corresponding to the first loudspeaker SP1, and a "failure list" is generated. The failure list shows information about whether the respective loudspeakers SP1 to SPm have a failure. In step 304, the status of all of the loudspeakers SP1 to SPm is temporarily set to "failure".

In step 305, the levels of the frequency components separated from each other in step 303 are compared with the levels of the noise components stored in the memory in step 114 of the routine 100. In this comparison, the levels of signals Sa and Sb included in a test tone signal STT supplied to the loudspeaker indicated by the loudspeaker number SN are compared with the levels of noise components Na and Nb whose frequencies are equal to those of the signals Sa and Sb (FIG. 5). The frequencies of the signals Sa and Sb to be compared can be known on the basis of the loudspeaker number SN, the variable SEQ, and the pattern number PN (FIG. 3).

If the comparison result is the above-described (i), the process proceeds from step 305 to step 306, where the status of the loudspeaker indicated by the loudspeaker number SN is set to "normal" in the failure list generated in step 304. Then, the process proceeds to step 307.

If the comparison result obtained in step 305 is (ii), the process skips to step 307.

In step 307, whether all of the loudspeakers SP1 to SPm have been checked is determined by referring to the loudspeaker numbers SN. If a loudspeaker that has not been checked exists, the process proceeds from step 307 to step 308, where the loudspeaker number SN is incremented by one and the next loudspeaker is checked. Then, the process returns to step 305.

In this way, the status of all of the loudspeakers SP1 to SPm is determined on the basis of the comparison of the levels of the signals Sa and Sb in the response signal STT, and the information in the failure list is set to "normal" for a normal loudspeaker.

After the status of all of the loudspeakers SP1 to SPm has been determined, the process proceeds from step 307 to step 309, so that the routine 300 completes.

Incidentally, in step 204 of the routine 200, whether any of the loudspeakers SP1 to SPm has a failure is determined on the basis of the failure list updated in step 306. In step 208, the loudspeaker number SN or the like of a broken loudspeaker is displayed on the LCD panel 35.

As described above, according to the routines 100 to 300, whether any of the loudspeakers SP1 to SPm has a failure can be determined and the determination result can be reported.

<8> Example of the Signal Generating Circuit 31

Figure 10:
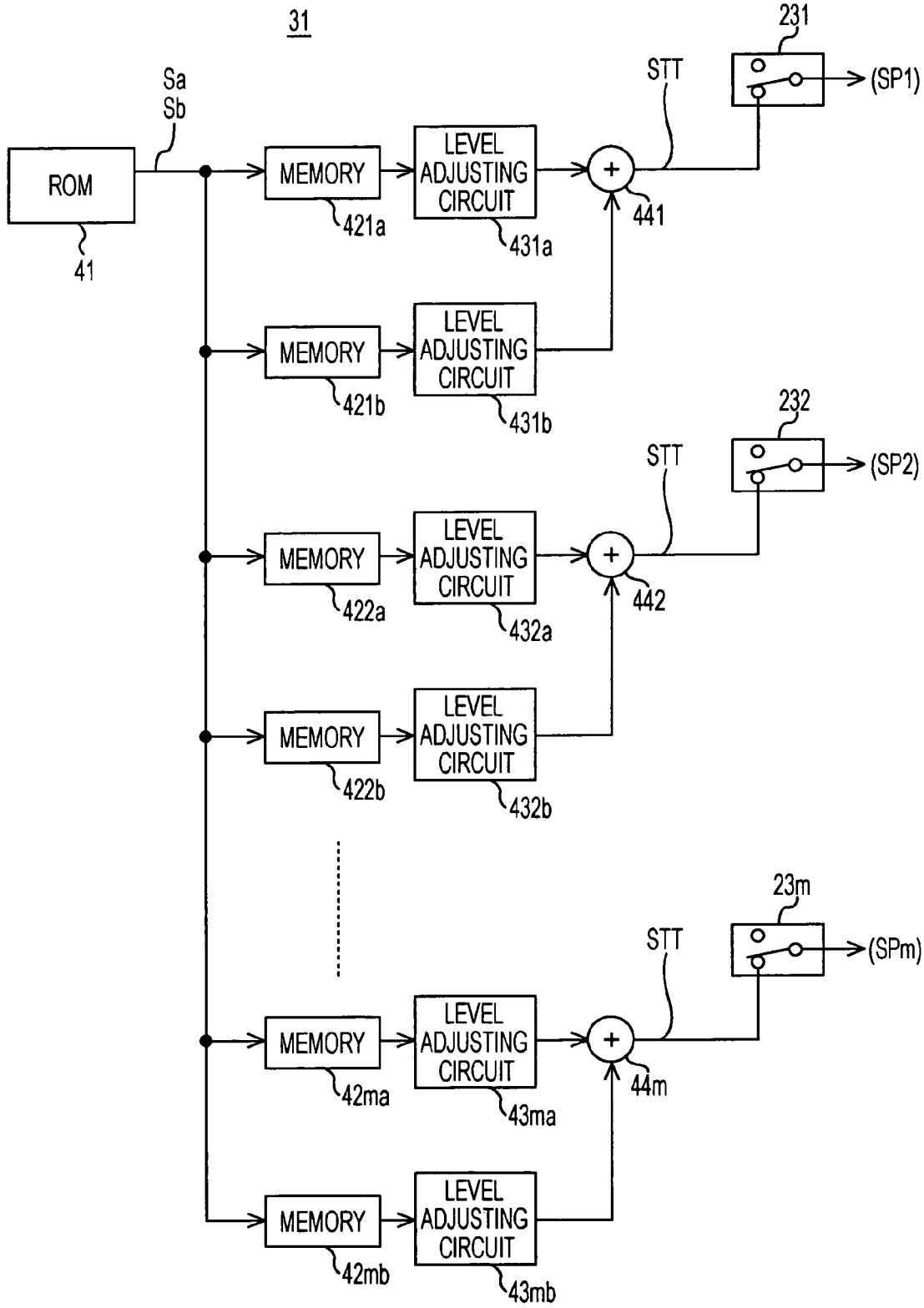
FIG. 10 is a systematic diagram showing part of the apparatus shown in FIG. 6.

FIG. 10 shows an example of a configuration of the signal generating circuit 31 composed of individual circuits. In this example, a ROM (read only memory) 41 stores digital data DD to be converted to one cycle of the sinusoidal signal S1 shown in A in FIG. 1. During the time TN, the digital data DD is read every "a" addresses of the ROM 41 and the reading is repeated "a" times, so that a sinusoidal signal Sa is captured and is written in a memory 421*a*.

During another time TN, the digital data DD stored in the ROM 41 is read every "b" addresses of the ROM 41 and the reading is repeated "b" times, so that a sinusoidal signal Sb is captured and is written in a memory 421*b*. Therefore, the sinusoidal signals Sa and Sb are stored in the memories 421*a* and 421*b* while being synchronized.

Then, the signals Sa and Sb in the memories 421*a* and 421*b* are simultaneously read in each time TN, the levels of the read signals Sa and Sb are adjusted by level adjusting circuits 431*a* and 431*b*, the signals Sa and Sb are supplied to an adder 441 and are added to a test tone signal STT, and then the test tone signal STT is output through the switching circuit 231.

Likewise, test tone signals STT for the loudspeakers SP2 to SPm are generated by memories (422*a*, 422*b*) to (42*ma*, 42*mb*), level adjusting circuits (432*a*, 432*b*) to (43*ma*, 43*mb*), and adders 442 to 44*m*, and the generated test tone signals STT are output through the switching circuits 232 to 23*m*.

In this way, the test tone signals STT to be supplied to the loudspeakers SP1 to SPm can be generated. If the signal generating circuit 31 includes a DSP (digital signal processor) or a CPU (central processing unit), the process performed in the memories 421*a* to 42*mb* and thereafter may be performed on the digital data DD stored in the ROM 41.

<9> Another Example of the Tone Frequency List and the Tone Sequence List

FIG. 11 shows another example of the tone frequency list. In this example, 384 types of test tone signals STT (PN=1 to 384) can be used. In this tone frequency list, too, frequencies fa and fb of sinusoidal signals Sa and Sb in the respective test tone signals STT are different from each other.

FIG. 12 shows another example of the tone sequence list. In the tone sequence list shown in FIG. 3, the number of the pattern numbers PN is the same as the number of the loudspeakers SP1 to SPm, so that the combination of the loudspeaker numbers SN and the pattern numbers PN is changed in each check. On the other hand, in the example shown in FIG. 12, all of the pattern numbers PN used in the first to third checks are different from each other.

<10> Conclusion

According to the above-described checking apparatus, test tone signals STT of different frequencies are simultaneously supplied to the loudspeakers SP1 to SPm of the playback apparatus, frequency analysis is performed on test tones output from the loudspeakers SP1 to SPm, and a failure in each loudspeaker is determined on the basis of frequency components corresponding to the loudspeakers SP1 to SPm. In this method, poor connection or disconnection of a voice coil can be swiftly detected.

Furthermore, check is repeatedly performed by changing the frequencies of the test tone signals STT as necessary. Therefore, whether the respective loudspeakers SP1 to SPm have a failure can be accurately checked even if the frequency characteristic of the loudspeakers SP1 to SPm has a dip. Also, since each test tone signal STT is composed of integer cycles of sinusoidal signals Sa and Sb, frequency analysis of a test tone by FFT can be easily performed.

<11> Others

In the above-described embodiment, all of the loudspeakers SP1 to SPm are simultaneously checked. Alternatively, the loudspeakers SP1 to SPm can be divided into a plurality of groups and check can be performed in units of the groups. Additionally, the terminal 21 to the amplifiers 241 to 24*m* can be accommodated together with the loudspeakers SP1 to SPm in one cabinet.

The present invention can also be applied when a failure of loudspeakers is checked in a multichannel stereo system, such as a 5.1 channel stereo system, or in a multiway loudspeaker system, such as a three-way loudspeaker system. The signal generating circuit 31 can be realized by the microcomputer included in the control circuit 25. Frequency analysis of a response signal STT can be performed by a dedicated DSP or CPU.

It should be understood by those skilled in the art that various modifications, combinations, sub-combinations and alterations may occur depending on design requirements and other factors insofar as they are within the scope of the appended claims or the equivalents thereof.

The invention claimed is:

1. A loudspeaker checking apparatus comprising:

a signal generating unit configured to generate a test tone signal by adding first and second sinusoidal signals of different frequencies;

a control circuit configured to allow the signal generating unit to generate a plurality of test tone signals by varying the frequencies;

an output circuit configured to simultaneously supply the plurality of test tone signals to a plurality of loudspeakers, respectively;

an analyzing unit configured to perform frequency analysis on an output signal from a microphone that picks up test tones output from the plurality of loudspeakers; and a determining unit configured to determine whether the respective loudspeakers are normal or abnormal on the basis of an analysis result made by the analyzing unit, wherein the signal generating unit includes:

a memory storing digital data representing one cycle of a sinusoidal signal;

a first generating unit configured to generate the first sinusoidal signal having a frequency x times that of the sinusoidal signal by reading the digital data from the memory every x samples, x being a natural number;

a second generating unit configured to generate the second sinusoidal signal having a frequency y times that of the sinusoidal signal by reading the digital data from the memory every y samples, y being a natural number different from x; and an adding circuit configured to add the first and second sinusoidal signals so as to generate the test tone signal.

2. The loudspeaker checking apparatus according to claim 1, wherein the analyzing unit performs frequency analysis on dark noise by using an output signal from the microphone before the test tones are output from the plurality of loudspeakers and allows the output circuit to output the test tone signals if the level of the dark noise is lower than a predetermined value.

3. The loudspeaker checking apparatus according to claim 1, wherein, if the determining unit determines that at least one of the loudspeakers has not output the test tone, the control circuit performs control so that the frequency analysis and the determination are performed again under different frequencies of the first and second sinusoidal signals.

4. A loudspeaker checking method comprising the steps of:

generating a test tone signal by adding first and second sinusoidal signals of different frequencies;

generating a plurality of test tone signals by varying the frequencies;

simultaneously supplying the plurality of test tone signals to a plurality of loudspeakers, respectively;

performing frequency analysis on an output signal from a microphone that picks up test tones output from the plurality of loudspeakers; and determining whether the respective loudspeakers are normal or abnormal on the basis of a result of the frequency analysis, wherein the step of generating a test tone signal includes the steps of:

generating the first sinusoidal signal having a frequency x times that of a sinusoidal signal by taking digital data representing one cycle of the sinusoidal signal every x samples, x being a natural number;

generating the second sinusoidal signal having a frequency y times that of the sinusoidal signal by taking the digital data every y samples, y being a natural number different from x; and adding the first and second sinusoidal signals so as to generate the test tone signal.

* * * * *